US008677780B2

(12) United States Patent
Mak

(10) Patent No.: US 8,677,780 B2
(45) Date of Patent: Mar. 25, 2014

(54) CONFIGURATIONS AND METHODS FOR RICH GAS CONDITIONING FOR NGL RECOVERY

(75) Inventor: John Mak, Santa Ana, CA (US)

(73) Assignee: Fluor Technologies Corporation, Aliso Viejo, CA (US)

( * ) Notice: Subject to any disclaimer, the term of this patent is extended or adjusted under 35 U.S.C. 154(b) by 861 days.

(21) Appl. No.: 12/304,734

(22) PCT Filed: Jul. 9, 2007

(86) PCT No.: PCT/US2007/015724

§ 371 (c)(1),
(2), (4) Date: Jan. 8, 2009

(87) PCT Pub. No.: WO2008/008335

PCT Pub. Date: Jan. 17, 2008

(65) Prior Publication Data

US 2009/0165498 A1 Jul. 2, 2009

Related U.S. Application Data

(60) Provisional application No. 60/830,151, filed on Jul. 10, 2006.

(51) Int. Cl.
*F25J 3/02* (2006.01)

(52) U.S. Cl.
USPC ..... 62/620; 62/630

(58) Field of Classification Search
USPC ..... 62/620, 626, 630, 611, 618
See application file for complete search history.

(56) References Cited

U.S. PATENT DOCUMENTS

| | | | | |
|---|---|---|---|---|
| 3,405,530 | A * | 10/1968 | Denahan et al. | 62/630 |
| 4,157,904 | A | 6/1979 | Campbell et al. | |
| 4,251,249 | A | 2/1981 | Gulsby | |
| 4,430,103 | A | 2/1984 | Gray et al. | |
| 4,617,039 | A | 10/1986 | Buck | |
| 4,690,702 | A | 9/1987 | Paradowski et al. | |
| 4,707,171 | A * | 11/1987 | Bauer | 62/625 |
| 4,720,299 | A * | 1/1988 | Milionis | 75/490 |
| 5,275,005 | A | 1/1994 | Campbell et al. | |
| 5,561,988 | A | 10/1996 | Mehra | |
| 5,799,507 | A | 9/1998 | Wilkinson et al. | |
| 5,890,377 | A | 4/1999 | Foglietta | |
| 5,890,378 | A | 4/1999 | Rambo et al. | |
| 6,116,050 | A * | 9/2000 | Yao et al. | 62/630 |
| 6,182,469 | B1 | 2/2001 | Campbell et al. | |
| 6,244,070 | B1 | 6/2001 | Lee et al. | |
| 7,051,552 | B2 * | 5/2006 | Mak | 62/621 |
| 7,237,407 | B2 * | 7/2007 | Paradowski | 62/620 |

(Continued)

FOREIGN PATENT DOCUMENTS

| | | | |
|---|---|---|---|
| WO | WO 2004/065868 A2 * | 8/2004 | |
| WO | WO 2006/009646 A2 * | 1/2006 | F25J 1/00 |

*Primary Examiner* — Frantz Jules
*Assistant Examiner* — Brian King
(74) *Attorney, Agent, or Firm* — Fish & Associates, PC

(57) ABSTRACT

Contemplated gas treatment plants for recovery of NGL from rich feed gas include an upstream conditioning unit in which heavier hydrocarbons, and most typically C5 and heavier are removed prior to feeding the processed feed gas to an NGL recovery plant, thus avoiding the need to process the heavier hydrocarbons in the NGL recovery plant. Such conditioning units advantageously reduce energy demand for dehydration otherwise required and allow for production of C2-C4, and C5+ streams that can be sold as valuable products.

20 Claims, 1 Drawing Sheet

(56) References Cited

U.S. PATENT DOCUMENTS

| | | | | |
|---|---|---|---|---|
| 7,377,127 | B2 * | 5/2008 | Mak | 62/630 |
| 7,568,363 | B2 * | 8/2009 | Runbalk | 62/611 |
| 2004/0148964 | A1 * | 8/2004 | Patel et al. | 62/620 |
| 2004/0206112 | A1 * | 10/2004 | Mak | 62/617 |
| 2004/0237580 | A1 * | 12/2004 | Mak | 62/620 |
| 2005/0066686 | A1 * | 3/2005 | Wilkinson et al. | 62/620 |
| 2006/0283207 | A1 * | 12/2006 | Pitman et al. | 62/620 |
| 2007/0012072 | A1 * | 1/2007 | Qualls et al. | 62/613 |

* cited by examiner

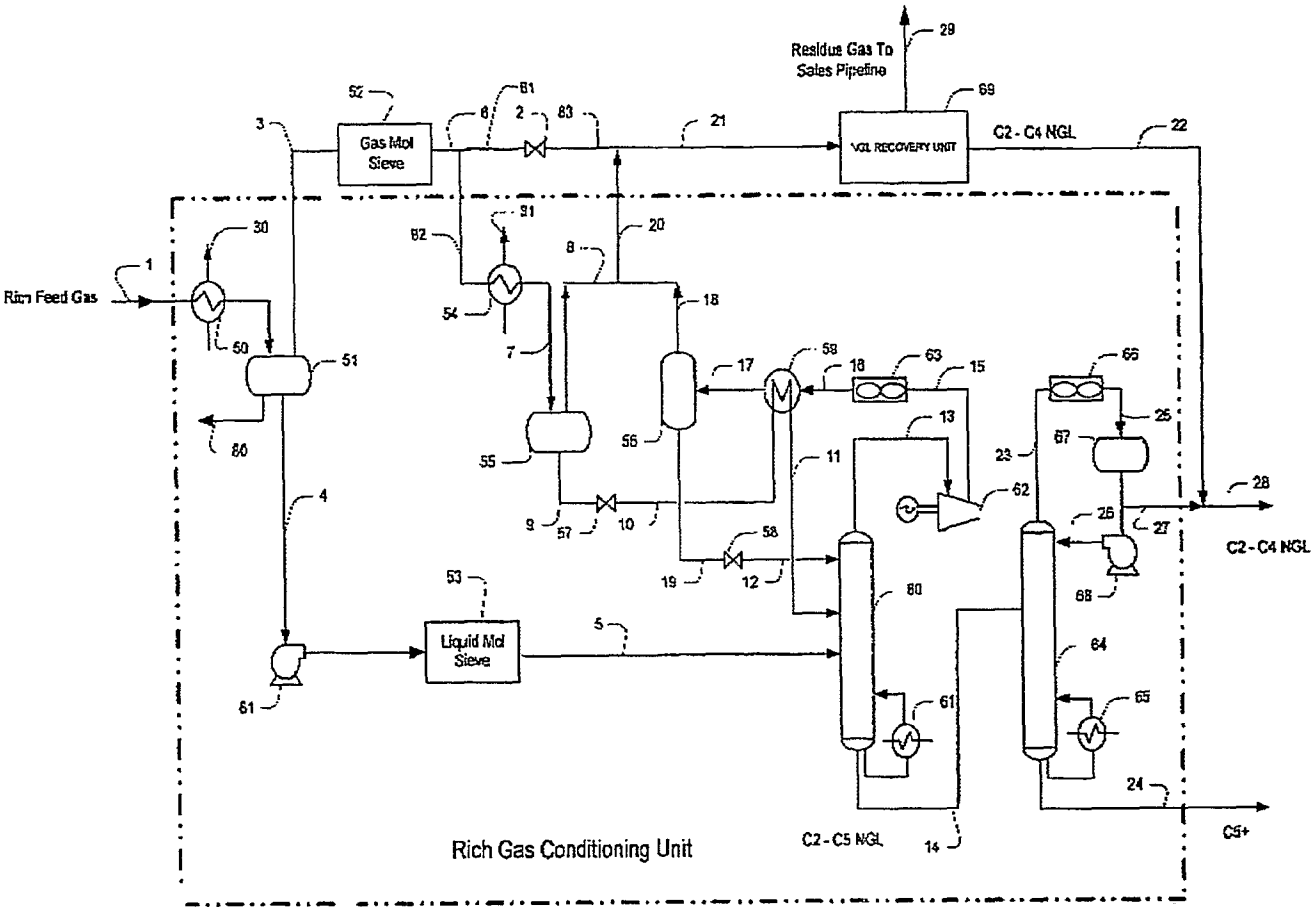
Rich Gas Conditioning Unit
Rim Feed Gas
Gas Mol Sieve
Liquid Mol Sieve
VOL RECOVERY UNIT
Residue Gas To Sales Pipeline
C2 - C4 NGL
C2 - C4 NGL
C2 - C5 NGL
C5+

CONFIGURATIONS AND METHODS FOR RICH GAS CONDITIONING FOR NGL RECOVERY

This application claims priority to our U.S. provisional patent application with the Ser. No. 60/830,151, filed Jul. 10, 2006.

FIELD OF THE INVENTION

The field of the invention is recovery of natural gas liquids (NGL) from feed gases, and especially from C5+ rich feed gases.

BACKGROUND OF THE INVENTION

As new oil and gas wells are coming on line to meet increasing energy demand, many of the existing gas processing facilities are not well adapted to accommodate to the often richer gas compositions from these new wells. Most typically, such gas compositions are rich in NGL (Natural Gas Liquid) and contain substantial quantities of heavier hydrocarbons (e.g., C4 to C6), which frequently creates operating problems when fed to existing NGL recovery units.

For example, many known cryogenic expansion configurations and processes (e.g., as described in U.S. Pat. Nos. 4,157,904 to Campbell et al., 4,251,249 to Gulsby, 4,617,039 to Buck, 4,690,702 to Paradowski et al., 5,275,005 to Campbell et al., 5,799,507 to Wilkinson et al., and 5,890,378 to Rambo et al.) are configured for relatively high NGL recovery, however, only when supplied with a relatively narrow range of gas compositions, such as lean feed gases and/or feed gases with low C5+ content. Consequently, throughput and NGL recovery in such known plants is often reduced when feed gas compositions are significantly different than originally planned, which often translates to significant product revenue loss. In such instances, processing equipment will typically have to be revamped to maintain a high NGL recovery, which often requires extensive shutdown of the plant at substantial product revenue loss. Moreover, significant capital expenditure is necessary, for example, to include new refrigeration units, new heat exchangers, or to re-wheel turboexpanders. In other cases, the demethanizer column must be revamped (e.g., with high capacity trays) or even replaced to handle the richer gas. Alternatively, plant throughput and NGL recoveries can be reduced, which significantly reduces product revenues.

In still other examples (e.g., U.S. Pat. No. 6,182,469 to Campbell et al., U.S. Pat. No. 6,244,070 to Lee et al., and U.S. Pat. No. 5,890,377 to Foglietta), the demethanizer reboilers are closely heat integrated with the feed gas exchangers, and therefore have an increased duty with an increase in richness of the feed gases. In such plants, liquids from the intermediate separators are fed to various tray locations in the demethanizer, which are optimized for the design feed composition. However, the fractionation efficiencies will be significantly reduced when operating on different feed gas compositions. In addition, the absorber overhead is often cooled and refluxed by a lean stream which composition is also dependent on the feed gas composition. It should be noted that high recoveries of the NGL components (C2 to C5 and heavier) in such plants are generally based on an optimum design for a narrow range of gas compositions. Consequently, as feed gases become richer (i.e. higher C4-C6 component content), these plants typically fail to achieve the desirable throughput and recovery due to the limitations of the refrigeration capacity and the demethanizer system that was originally designed for leaner gases.

Therefore, although various configurations and methods are known to recover NGL from a feed gas, all or almost all of them suffer from one or more disadvantages, especially where the feed gas is relatively rich. Therefore, there is still a need to provide methods and configurations for improved NGL recovery.

SUMMARY OF THE INVENTION

The present invention is directed to plant configurations and methods in which a rich feed gas is conditioned in a conditioning unit to remove a portion of the heavier components to thereby allow operation of a conventional downstream NGL recovery plant under variable feed gas conditions and/or with rich feed gas in an economically attractive manner.

In one aspect of the inventive subject matter, a method of conditioning a rich feed gas in a conditioning unit includes a step of cooling and separating a rich feed gas into a liquid portion and a vapor portion, and a step of further cooling the vapor portion and separating the cooled vapor portion into a C5+ depleted vapor stream and in a C5+ enriched liquid stream. In still another step, the C5+ enriched liquid stream and the liquid portion are separated in a refluxed fractionator into a C2-C5 bottom product and an overhead product, and the overhead product is cooled and separated into a reflux liquid for the fractionator and a lean vapor. The lean vapor and the C5+ depleted vapor stream are then routed to a downstream NGL recovery plant.

Most preferably, the rich feed gas (e.g., having at least 20 mol % C2+ components with at least 2.5 mol % C5+ components) is cooled to a temperature of about 1-20° F. above the hydrate point of the rich feed gas, and water is removed from the cooled rich feed gas. Most typically, the liquid portion and the vapor portion are further dried (e.g., in molecular sieve units). Additionally, it is generally preferred to reduce the pressure of the C5+ enriched liquid stream to thereby provide reflux condensing duty prior to feeding the C5+ enriched liquid stream to the fractionator, and/or to expand the reflux liquid prior to feeding the reflux liquid into the fractionator.

In still further contemplated aspects, the C2-C5 bottom product from the fractionator is separated into a C5+ fraction and a C2-C4 NGL product, and a portion of the C2-C4 NGL product is employed as a reflux to the debutanizer while another portion of the C2-C4 NGL product is combined with an NGL product of the NGL recovery plant.

Thus, and viewed from a different perspective, a gas conditioning unit for processing a rich feed gas upstream of a natural gas liquid NGL) recovery plant includes a separator that is configured to separate a cooled and dehydrated vapor phase of a cooled rich feed gas into a C5+ depleted vapor stream and a C5+ enriched liquid stream. An expansion device (e.g., JT valve or expansion turbine) is configured to at least partially depressurize the C5+ enriched liquid stream and is coupled to a refluxed fractionator that receives the partially depressurized C5+ enriched liquid stream, wherein the refluxed fractionator is further configured to provide an overhead product to a reflux separator downstream of a reflux condenser. The reflux condenser duty is provided by refrigeration content of the at least partially depressurized C5+ enriched liquid stream to the overhead product. In such units, the separator and the reflux separator are configured to provide the C5+ depleted vapor stream and a lean vapor to the NGL recovery plant, respectively, and the refluxed fractionator is further configured to receive a cooled and dehydrated liquid phase of the cooled rich feed gas and to produce a C2-C5 bottom product.

Most typically, a second separator is included and configured to separate the cooled rich feed gas into a feed gas vapor and a feed gas liquid, wherein the second separator is fluidly coupled to the fractionator to allow delivery of the feed gas liquid to the separator. The second separator is preferably coupled to a dryer unit that is configured to dry the feed gas vapor to thereby produce the dehydrated vapor phase of the rich feed gas. Where desirable, the second separator is configured to allow removal of water from the cooled rich feed gas. A rich feed gas cooler is further preferably included and configured to cool the rich feed gas to a temperature of 1-20° F. above a hydrate point of the rich feed gas, wherein the rich feed gas cooler is fluidly coupled to the second separator.

In still further preferred aspects, the reflux separator is configured to produce a reflux liquid, and a second expansion device is configured to reduce pressure of the reflux liquid. Additionally, contemplated units will typically include a (refluxed) debutanizer that is fluidly coupled to the fractionator, and that is further configured to produce from the C2-C5 bottom product a C2-C4 NGL debutanizer overhead product and a C5+ bottom product. A conduit is preferably fluidly coupled between the NGL recovery plant and the debutanizer to allow combination of the C2-C4 NGL debutanizer overhead product and an NGL product of the NGL recovery plant.

Various objects, features, aspects and advantages of the present invention will become more apparent from the following detailed description of preferred embodiments of the invention along with the accompanying drawing.

BRIEF DESCRIPTION OF THE DRAWING

FIG. 1 is an exemplary schematic of a plant configuration with an upstream feed gas conditioning unit.

DETAILED DESCRIPTION

The inventor has discovered that high NGL recovery can be maintained in an existing or new NGL recovery plant receiving a C5+ rich (e.g., >2 mol %) content feed gas by adding an upstream conditioning facility that produces a C5+ depleted lean gas (e.g., less than 2 mol %) to feed the existing NGL plant while producing NGL and/or C5+ product. Therefore, using such upstream conditioning facilities allows an NGL plant to accept a wide range of feed gas compositions while maintaining high NGL recovery and high throughput at lower energy consumption than currently known NGL processes. Moreover, contemplated upstream conditioning facilities also significantly reduce required dehydration energy and further avoid processing of the heavy components (C5+) in the NGL recovery plant.

Therefore, and viewed from yet another perspective, contemplated upstream facilities increase the capacity and recovery of an existing NGL recovery unit when used to process a rich gas by removing the heavier hydrocarbons (C5+) from the feed gas before being routed to the existing NGL recovery unit. Contemplated upstream facilities will typically include a debutanizer that separates the bottoms from a fractionator into a C5+ enriched bottoms and an NGL (C2, C3, C4) overhead product. Under most circumstances, recovery of the C5+ in the upstream facility is typically between about 60% to 90%. It should further be recognized that contemplated upstream conditioning units may receive only a fraction of the feed gas where the feed gas is less rich but conditioning is still desired.

An exemplary configuration is depicted in FIG. 1, in which rich wet feed gas 1 at about 1000 psig and about 140° F. has a typical composition (1.5% CO2, 0.5 N2, 74.54% C1, 9.74% C2, 6.55 C3, 4.2% C4, 1.79% C5 and 1.2% C6 plus, on molar basis) and is cooled in the feed gas cooler 50 using propane refrigerant stream 30 to just above the hydrate formation point of the feed gas (typically about 60° F. to about 75° F.). A downstream feed separator 51 (most preferably a three phase separator) removes water 80 from the cooled feed gas, thus advantageously reducing the size and energy consumption of the downstream dehydration units. The feed separator further separates the cooled feed gas into a liquid portion 4 and a vapor portion 3. The liquid portion 4 is pumped using pump 81 to a liquid molecular sieve dehydrator 53 (or other unit, e.g., TEG dehydration unit) to remove residual water from the feed liquid, which is then routed as stream 5 to the stripping section of fractionator 60 NGL for recovery.

Vapor stream 3 from the feed separator 51 is dried in a gas dryer unit 52 (preferably using molecular sieves) to produce stream 6 which is then split into two streams 81 and 82. Normally, valve 2 is closed, and most of the flow is diverted to the upstream conditioning plant (i.e. stream 82). Stream 82 is then chilled in cooler 54 to form stream 7 using propane refrigeration 31 to about 30° F. to 45° F. The so dried and chilled vapor portion is then fed into a second separator 55, which separates a C5+ enriched liquid stream 9 from the dried and chilled vapor portion stream 8. The liquid portion is let down in pressure to about 400 psig using JT valve 57, forming stream 10 at about 23° F. The refrigeration content of stream 10 is used to supply cooling to the fractionator overhead stream 16 in exchanger 59 while being heated to 80° F. forming stream 11, which is fed to the upper section of the fractionator 60 that is reboiled using conventional reboiler 61.

The fractionator 60 operating at about 300 psig to 420 psig separates the feed liquid streams 5 and 11, into a C5+ enriched bottoms stream 14 and a C5 depleted overhead vapor overhead stream 13. The liquid stream 19, from reflux drum 56, is let down in pressure and chilled via JT valve 58, and is then fed to the fractionator as reflux 12. Overhead stream 13 is compressed in overhead compressor 62 to about 1000 psig pressure forming 15, and is cooled by air cooler 63 forming stream 16 that is further cooled by the letdown of the second feed separator liquid forming stream 17. The chilled stream 17 is then separated in reflux drum 56 into a vapor stream 18 and a liquid stream 19.

The reflux drum vapor stream 18 is combined with the overhead vapor stream 8 of the second feed separator, forming stream 20, which is fed (together with stream 83) as stream 21 to the NGL recovery plant 69. This combined stream typically contains no more than 0.5 mol % C5+ hydrocarbons. With such significant reduction in C5+ content of the feed stream, the NGL recovery unit can be used to process a higher throughput at a higher NGL recovery. Furthermore, using such upstream conditioning, no modifications are required in the existing downstream NGL plant to achieve high NGL recovery and/or higher throughput. Still further, operating flexibility is achieved by combination of stream 20 with stream 83, derived from stream 81. Flow of stream 83 is typically a function of the C5+ content of the rich feed gas, and it should be appreciated that flow of stream 83 may be between 0 and 100% of the flow of stream 6.

The fractionator bottoms stream 14 is further fractionated in debutanizer 64 into an NGL overhead liquid stream 23 and a bottom C5+ product stream 24. One portion of the NGL overhead liquid is typically used as reflux stream 26 to the debutanizer 64 via condenser 66 forming condensate stream 25, drum 67, and reflux pump 68. Another portion of the NGL stream 27 can be combined with the NGL stream 22 from the NGL recovery unit 69 forming the total NGL product stream 28. The debutanizer is typically designed with conventional reboiler 65. Thus, it should be noted that the NGL recovery unit 69 receives a lean feed gas (C5+ depleted) as used in original or typical NGL design, and produces a residue gas 29 and NGL product 22. The term "C5+ enriched" liquid, vapor, or other fraction as used herein means that the liquid, vapor, or other fraction has a higher molar fraction of C5, C5 isoforms, and/or heavier components than the liquid, vapor, or other fraction from which the C5(+) enriched liquid, vapor, or other fraction is derived. Similarly, the term "C5+ depleted" liquid, vapor, or other fraction as used herein means that the liquid, vapor, or other fraction has a lower molar fraction of C5, C5 isoforms, and/or heavier components than the liquid, vapor, or other fraction from which the C5+ depleted liquid, vapor, or other fraction is derived. As still further used herein, the term "about" in conjunction with a numeral refers to a range of that numeral starting from 20% below the absolute of the numeral to 20% above the absolute of the numeral, inclusive. For example, the term "about −100° F." refers to a range of −80° F. to −120° F., and the term "about 1000 psig" refers to a range of 800 psig to 1200 psig.

With respect to the feed gas it is generally contemplated that suitable feed gases will predominantly (>50 mol %) comprise methane and will further include heavier hydrocarbons and optionally non-hydrocarbon compounds, including carbon dioxide and hydrogen sulfide. Consequently, it should be appreciated that the nature of the feed gas may vary considerably, and all feed gases in plants are considered suitable feed gases so long as they comprise C2 and C3 components, and more typically C1-C5 components, and most typically C1-C6+ components. Therefore, particularly preferred feed gases include natural gas, refinery gas, and synthetic gas streams obtained from other hydrocarbon materials such as coal, crude oil, naphtha, oil shale, tar sands, and lignite. Suitable gases may also contain relatively lesser amounts of heavier hydrocarbons such as propane, butanes, pentanes and the like, as well as hydrogen, nitrogen, carbon dioxide and other gases. Depending on the particular source and nature of the feed gas, it should be recognized that the cooling of the feed gas may vary considerably. However, it is generally preferred that the feed gas is cooled to a temperature that is above (typically between about 1-5° F., more typically between about 1-10° F., and most typically between about 1-20° F.) the hydrate point of the feed gas. Therefore, where the feed gas is natural gas, exemplary cooled feed gas temperature will typically be in the range of about 55° F. to about 65° F. Similarly, and again depending on the particular source of the feed gas, the pressure may vary substantially. However, it is generally preferred that the feed gas has a pressure between about 800 psig to about 1400 psig, and more typically between about 1000 psig to about 1400 psig. Where the feed gas pressure is lower, upstream pumps and/or compressors may be used. Similarly, where higher feed gas pressures are present, pressure reducing devices may be employed, which advantageously may contribute energy and/or refrigeration to the conditioning unit.

With respect to the separators contemplated in the upstream conditioning plant herein, it should be recognized that all known (feed) separators are appropriate. However, and with respect to the rich feed separator, it is particularly preferred that the separator is a three-phase separator in which water can be separated from the hydrocarbonaceous liquid and vapor phases. Furthermore, the fractionator, heat exchanger, dryer, and compressor used herein are typically conventional devices well known to the skilled artisan.

It should be recognized that by using a feed cooler and feed separator, and by further cooling of the vapors from the feed cooler with subsequent separation of the cooled vapors in the intermediate separator (to form a C5+ enriched liquid and a C5+ depleted vapor), most, if not all of the heavier components are removed from the feed gas. Therefore, with the removal of the C5+ hydrocarbons in the upstream conditioning plant, the equipment in the existing downstream NGL recovery plant, including heat duties, the turbo expander, and the demethanizer will operate at their most efficient points independent of changes in the feed gas composition. Contemplated configurations and processes thus allow simple and flexible handling of varying feed gas flow rates and gas compositions that would enhance all known turbo-expander NGL processes. As a consequence, the complexity of operating a downstream turbo-expander (NGL plant) under varying gas compositions is significantly reduced without sacrificing NGL recovery and throughput. Viewed from another perspective, facilities and processes contemplated herein allow constant operating conditions for downstream NGL recovery plants by removal of the heavy components in the feed gas without requiring modifications of the NGL recovery plants in processing varying richer feed gases.

Especially preferred configurations include a first cooler and a first feed separator to remove at least some of the water and C5+ liquid, and most preferably include gas and liquid driers that receive and dry gas and liquid from the first separator to thereby generate an at least partially dehydrated gas, which is then further cooled by at least a second cooler to partially condense the majority of C5+ hydrocarbons (typically over 70%, and more typically over 75%). The first separator liquid can then be fed to the fractionator, and a second separator will then produce a C5+ depleted gas and a C5+ enriched liquid, wherein the C5+ depleted gas is fed to the NGL recovery unit, and the C5+ enriched liquid is letdown, chilled, and so provides cooling to the reflux condenser of the fractionator prior to feeding the fractionator. Viewed from a different perspective, it should be appreciated that cooling and fractionation allows the heavier components to be condensed (wherein at least part of the cooling duty is provided by expansion of the liquid components), while the lighter components are combined and fed to the downstream NGL recovery plant. Where the feed gas composition is variable, it should be appreciated that changes in composition can be accommodated by diverting variable portions of the rich feed gas into the upstream conditioning unit and/or by combining C2-C4 and/or C5+ from the conditioning unit with the rich feed gas.

With respect to the fractionator overhead vapor, it is typically preferred that the vapor is at least partially condensed using an ambient cooler and a heat exchanger, wherein the exchanger preferably uses refrigeration content from the letdown liquid from the separator that forms the C5+ enriched liquid and the C5+ depleted gas. The so chilled overhead vapor is further separated in a third separator (reflux separator) that provides a liquid stream that is letdown in pressure to the fractionator as a top reflux, while the vapor from the third separator is preferably combined with the C5+ depleted gas. The C5+ depleted gas from the fractionator overhead is typically compressed to suitable pressure using conventional devices.

Thus, specific embodiments and applications related to rich gas conditioning for NGL recovery have been disclosed. It should be apparent, however, to those skilled in the art that many more modifications besides those already described are possible without departing from the inventive concepts herein. The inventive subject matter, therefore, is not to be restricted except in the spirit of the present disclosure. Moreover, in interpreting the specification and contemplated claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Furthermore, where a definition or use of a term in a reference, which is incorporated by reference herein is inconsistent or contrary to the definition of that term provided herein, the definition of that term provided herein applies and the definition of that term in the reference does not apply.

What is claimed is:

1. A method of conditioning a rich feed gas containing C1, C2 to C4, and C5+ in a conditioning unit, comprising:

cooling and separating the rich feed gas into a liquid portion and a vapor portion;

further cooling a first fraction of the vapor portion and separating the cooled vapor portion into a C5+ depleted vapor stream and a C5+ enriched liquid stream;

separating the C5+ enriched liquid stream and the liquid portion in a refluxed fractionator into a C2-C5 enriched bottom product and an overhead product;

compressing and cooling the overhead product and separating the compressed and cooled overhead product into a reflux liquid for the fractionator and a lean vapor;

wherein the step of cooling the overhead product to obtain the reflux liquid is performed by reducing pressure of the C5+ enriched liquid stream and using refrigeration obtained from the step of reducing pressure in the step of cooling the overhead product; and combining a second fraction of the vapor portion, the lean vapor, and the C5+ depleted vapor stream to form a C2 to C4-containing combined stream, and feeding the combined stream to a downstream NGL recovery plant for separation of C2 to C4 from C1.

2. The method of claim 1 wherein the rich feed gas is cooled to a temperature of 1-20° F. above a hydrate point of the rich feed gas, and wherein water is removed from the cooled rich feed gas.

3. The method of claim 2 further comprising a step of further drying the liquid portion and the vapor portion.

4. The method of claim 1 further comprising a step of feeding the C5++ enriched liquid stream to the fractionator after the step of reducing pressure of the C5++ enriched liquid stream.

5. The method of claim 1, further comprising a step of expanding the reflux liquid prior to feeding the reflux liquid into the fractionator.

6. The method of claim 1 further comprising a step of separating in a debutanizer the C2-C5 bottom product into a C5+ fraction and a C2-C4 NGL product.

7. The method of claim 6 further comprising a step of using one portion of the C2-C4 NGL product as reflux to the debutanizer.

8. The method of claim 7 further comprising a step of combining another portion of the C2-C4 NGL product with an NGL product of the NGL recovery plant.

9. The method of claim 1 wherein the conditioning unit is provided as a retrofit to the NGL recovery plant.

10. The method of claim 1 wherein the rich feed gas comprises at least 20 mol % C2+ components with at least 2.5 mol % C5+ components.

11. A gas conditioning unit for operation upstream of a natural gas liquid (NGL) recovery plant and configured to process a rich feed gas containing C1, C2 to C4, and C5+, comprising:

a first separator configured to separate a cooled and dehydrated first portion of a vapor phase of a cooled rich feed gas in a C5+ depleted vapor stream and in a C5+ enriched liquid stream;

an expansion device configured to receive and at least partially depressurize the C5+ enriched liquid stream and coupled to a refluxed fractionator via a heat exchanger, wherein the fractionator is configured to receive the at least partially depressurized C5+ enriched liquid stream;

wherein the refluxed fractionator is coupled to a compressor, and wherein the refluxed fractionator and compressor are further configured to provide a compressed overhead product to a reflux separator downstream of the heat exchanger, and wherein the heat exchanger is configured to provide refrigeration content of the at least partially depressurized C5+ enriched liquid stream to the overhead product;

conduits coupled to the first separator and the reflux separator, wherein the conduits are configured such as to allow combining a second portion of the vapor phase of the cooled rich feed gas, the C5+ depleted vapor stream, and a lean vapor to form a C2 to C4-containing combined stream, and to allow feeding the combined stream to the NGL recovery plant for separation of C2 to C4 from C1; and wherein the refluxed fractionator is configured to receive a cooled and dehydrated liquid phase of the cooled rich feed gas and to produce a C2-C5 bottom product.

12. The gas conditioning unit of claim 11 further comprising a second separator that is configured to separate the cooled rich feed gas into a feed gas vapor and a feed gas liquid, wherein the second separator is fluidly coupled to the fractionator to allow delivery of the feed gas liquid to the fractionator and wherein the second separator is fluidly coupled to a dryer unit that is configured to dry the feed gas vapor to thereby produce the dehydrated vapor phase of the rich feed gas.

13. The gas conditioning unit of claim 12 wherein the second separator is further configured to allow removal of water from the cooled rich feed gas.

14. The gas conditioning unit of claim 12 further comprising a rich feed gas cooler that is configured to cool the rich feed gas to a temperature of 1-20° F. above a hydrate point of the rich feed gas, and wherein the rich feed gas cooler is fluidly coupled to the second separator.

15. The gas conditioning unit of claim 11 wherein the expansion device is a JT valve or expansion turbine.

16. The gas conditioning unit of claim 11 wherein the reflux separator is configured to produce a reflux liquid.

17. The gas conditioning unit of claim 15 further comprising a second expansion device configured to reduce pressure of the reflux liquid.

18. The gas conditioning unit of claim 11 further comprising a debutanizer that is fluidly coupled to the fractionator, and that is further configured to receive the C2-C5 bottom product and to produce a C2-C4 NGL debutanizer overhead product and a C5+ bottom product.

19. The gas conditioning unit of claim 18 further comprising a conduit that is fluidly coupled between the NGL, recovery plant and the debutanizer to allow combination of the C2-C4 NGL debutanizer overhead product and an NGL product of the NGL recovery plant.

20. The gas conditioning unit of claim 18 wherein the debutanizer is a refluxed debutanizer.

* * * * *